US005520305A

United States Patent [19]

Pierson

[11] Patent Number: 5,520,305

[45] Date of Patent: May 28, 1996

[54] CONTAINER AND TWO PIECE SAFETY CAP HAVING A LOCKING COLLAR AND COVER

[75] Inventor: Theodore J. Pierson, Kinnelon, N.J.

[73] Assignee: Pierson Industries, Inc., Denville, N.J.

[21] Appl. No.: 412,730

[22] Filed: Mar. 29, 1995

[51] Int. Cl.[6] ..... B65D 25/42; B65D 41/17; B65D 43/00

[52] U.S. Cl. ..... 220/727; 215/206; 215/223; 215/225; 220/724; 220/915; 222/153.13; 222/182; 222/402.11

[58] Field of Search ..... 215/206, 201, 215/224, 225, 223; 222/182, 153.1, 153.11, 153.13, 153.14, 153.09, 402.11; 220/281, 915, 724, 727

[56] References Cited

U.S. PATENT DOCUMENTS

| | | | |
|---|---|---|---|
| 3,133,680 | 2/1961 | Sliwinski . | |
| 3,462,045 | 8/1969 | Markowitz | 222/182 |
| 3,632,024 | 1/1972 | Usen | 222/402.11 |
| 3,655,100 | 4/1972 | Markowitz | 222/182 |
| 3,690,519 | 9/1972 | Wassilieff | 220/915 X |
| 3,802,607 | 4/1974 | Mead . | |
| 3,850,327 | 11/1974 | Robinson | 215/225 |
| 3,866,802 | 2/1975 | Birrell . | |
| 3,884,393 | 5/1975 | Wassilieff | 222/402.11 X |
| 3,901,400 | 8/1975 | Westfall . | |
| 3,901,412 | 8/1975 | Copia | 222/402.11 X |
| 3,934,751 | 1/1976 | Green et al. . | |
| 3,938,710 | 2/1976 | Bennett . | |
| 3,964,634 | 6/1976 | Jasinski et al. | 215/224 X |
| 4,121,727 | 10/1978 | Robbins et al. . | |
| 4,133,448 | 1/1979 | Balfanz . | |
| 4,325,497 | 4/1982 | Ewald . | |
| 4,353,483 | 10/1982 | Pehr . | |
| 4,576,315 | 3/1986 | Vitale . | |
| 4,662,542 | 5/1987 | Vitale . | |
| 4,779,747 | 10/1988 | Morel . | |
| 5,027,982 | 7/1991 | Demarest | 222/402.11 X |
| 5,040,691 | 8/1991 | Hayes et al. . | |
| 5,040,694 | 8/1991 | Gambello . | |
| 5,085,347 | 2/1992 | Hayes et al. | 222/153.13 X |
| 5,092,493 | 3/1992 | Pehr | 215/224 X |
| 5,316,162 | 5/1994 | Pierson | 215/224 X |
| 5,356,043 | 10/1994 | Glynn . | |
| 5,397,008 | 3/1995 | Glynn | 215/206 X |

*Primary Examiner*—Allan N. Shoap
*Assistant Examiner*—Robin A. Hylton
*Attorney, Agent, or Firm*—Lerner, David, Littenberg, Krumholz & Mentlik

[57] ABSTRACT

A two-piece safety cap for a container is disclosed. The safety cap comprises a collar and a corresponding cover arranged for movement between a locked position at which it cannot be removed from the collar and a removable position at which it may be readily removed therefrom. The cover and the collar may normally be arranged in frictional engagement so that rotation of one of the components causes rotation of the other. In order to overcome the normal frictional engagement between the collar and the cover, it is necessary to rotate one of the components while restraining movement of the other component.

17 Claims, 4 Drawing Sheets

CONTAINER AND TWO PIECE SAFETY CAP HAVING A LOCKING COLLAR AND COVER

FIELD OF THE INVENTION

The present invention relates to safety caps for preventing young children from gaining access to potentially hazardous contents within an associated container.

BACKGROUND OF THE INVENTION

Safety caps for preventing children from gaining access to potentially hazardous contents stored within containers are well known in the closure art. Efforts expended in developing such safety caps have prevented thousands of accidental injuries from occurring each year. However, most prior art safety caps are undesirable because they are either too easy for a child to remove or too difficult for an adult to remove.

One effective prior art childproof cap is disclosed in U.S. Pat. No. 5,316,162 which issued to Pierson on May 31, 1994. This patent discloses a two-piece safety cap for a container which is universally adaptable when mounted on various sized pressurized containers which have a standard sized valve rim. The two-piece childproof cap disclosed in the aforementioned Pierson patent includes a collar and a cover having corresponding alignment arrows thereon so that an adult user would know when the cover may be removed from the collar and when the cover is in a locked position on the collar. The alignment arrow feature of the Pierson childproof cap is well known in the art.

Notwithstanding the effectiveness of the Pierson childproof cap, thousands of unnecessary emergencies occur every year when children accidentally come into contact with potentially dangerous products stored within containers. These products have various uses and are generally safe when used properly by a knowledgeable adult. However, many common types of household products such as cleaners, insecticides, paints and the like are stored within aerosol cans. These products are generally used by spraying them directly onto their intended target. Although, aerosol cans provide a quick and efficient way to dispense pressurized products from a container, these types of dispensers can also be dangerous if the pressurized products therein are misused. For example, blindness may result if a child accidentally sprays oven cleaner into his or her eyes. Other products can cause serious injuries if they are improperly applied to the lungs or skin of a person or an animal.

Even when aerosol containers are stored in generally safe places which may be difficult to access, children have a tendency to climb or find ways to gain access to the aerosol can. Thus, it is particularly important to provide a safety cap that cannot be removed from an associated container unless the user has the knowledge of how to open the cap so that children will be prevented from gaining access to potentially dangerous products within the container. Further, it is desirable for the safety cap to be easily removed from its locked position by an adult user.

Despite the many efforts which have been made to develop effective childproof caps for placement over the top of various types of containers, including pressurized containers, these efforts have not been entirely successful because children are often smarter than the manufacturers of safety caps give them credit for and thus, find ways to access the contents of a container. Moreover, many elderly people who may suffer from arthritis have difficulty in removing most prior art safety caps as they usually require a great deal of hand strength in order to remove them from their locked position.

In order to address these problems, the present invention provides a childproof safety cap which requires an additional amount of knowledge and coordination to open the safety cap. The required knowledge is easily understand by adults so that the alignment arrows can be quickly aligned and the cover can then be easily removed from its locked position on an associated collar without requiring a lot of hand strength. However, the knowledge required to open the present safety cap eliminates a large amount of risk associated with an unknowledgable child accidentally aligning arrows on the safety cap and thereafter removing the cover thereof.

SUMMARY AND OBJECTS OF THE INVENTION

The present invention pertains to a safety cap for use with containers, such as aerosol containers which have an outer shoulder and a valve rim. The safety cap may comprise a collar which has a substantially vertical side wall extending downwardly so that when it is placed in assembled position on the associated container, the substantially vertical side wall extends from the top of the container toward the bottom thereof. The collar may be seated on the outer shoulder of the container when it is placed in assembled position thereon. The collar includes a groove which extends circumferentially around the entire outer surface of the vertical side wall. The collar also includes a top side which extends between the substantially vertical side wall and the valve rim of the associated container. The top side includes a first end and a second end, whereby the second end of the top side is arranged beneath at least a portion of the valve rim to facilitate locking of the collar when it is placed on the associated container. The subject safety cap also includes a cover which is mountable on the collar for selective movement between a locked position, at which the cover is locked on the collar, and a removable position at which the cover can be easily removed from its mounted arrangement on the collar. The cover may have an inner surface and an outer surface and preferably includes at least one ridge and a projection attached to the inner surface which extends inwardly therefrom. The collar includes recess means arranged adjacent to the groove for permitting the cover to be mounted on the collar and removed therefrom. The ridge of the cover is adapted to be mounted within the groove of the collar and the projection is sized and shaped to fit within the recess means and the groove so that the cover can be selectively rotated on the collar between the locked and removable positions.

In one preferred embodiment, the first end of the top side of the collar is connected to the substantially vertical side wall at a location adjacent to the groove. In another preferred embodiment, the top side of the collar may comprise a continuous circumferential ring which is connected to the substantially vertical side wall at a first end. The top side extends to a location defining a second end which terminates beneath the valve rim of the associated container.

It is also preferable for the substantially vertical side wall of the collar to define a shoulder arranged adjacent to and beneath the groove so that the groove is disposed between the shoulder and the top side of the collar. In this preferred embodiment, the cover may have a bottom lip which is adapted to be seated on the shoulder of the collar when at least one ridge and the projection of the cover are arranged within the groove.

The safety cap of the present invention may also include alignment means for providing an indication when the cover is arranged in the locked and removable positions with respect to the collar. The alignment means may comprise a plurality of distinguishing marks arranged on the respective outer surfaces of the collar and the cover to indicate when the projection of the cover is aligned with the recess of the collar thereby indicating that the cover is arranged in a removable position or locked position.

When the safety cap of the present invention is used on a pressurized container which has a bulbous top portion, it is preferable for the top side of the collar to extend upwardly between the outer shoulder and the valve rim at a positive angle with respect to a horizontal plane.

In another preferred embodiment, the inner surface of the collar may include a locking tab which can be forced below the outer shoulder of an associated container when in assembled position so that the locking tab acts in conjunction with the top side of the container in order to facilitate locking of the collar on the associated container. To this end, the locking tab defines a diameter slightly smaller than the diameter defined by the outer shoulder of the associated container.

The inner surface of the collar may define a diameter which is slightly greater than the diameter defined by the outer shoulder of the associated container so that the collar is freely rotatable thereon. At the same time, it is preferable for the collar to be substantially permanently mounted on an associated container.

It is also preferable for the cover and the collar of the present safety cap to comprise friction engagement means for providing an initial frictional engagement between the collar and the cover when arranged in assembled position whereby rotation of the collar on the associated container will cause corresponding rotation of the cover and vice versa. This arrangement will effectively prevent removal of the cover from the locked position on the collar unless a person simultaneously holds both the cover and the collar and rotates only one of the components while restraining movement of the other one thus overcoming the initial frictional engagement until the cover is arranged in a removable position.

Accordingly, it is an object of the present invention to provide a safety cap having a two-piece molded construction which is effective but inexpensive to manufacture.

It is another object of the present invention to provide a safety cap including a collar and a cover wherein the collar is substantially permanently mounted on the top of an associated container. At the same time, it is an object of the present invention to provide means for allowing the cover to be selectively placed between a locked and a removable position with respect to the collar.

It is another object of the present invention to provide a safety cap which can be easily removed by a knowledgeable adult without using a great deal of hand strength, while an untrained child cannot readily ascertain how to remove the cover from the associated collar of the subject safety cap.

The aforementioned features and objects of the present invention will be more clearly understood when considered in conjunction with the detailed description and the accompanying drawings which follow.

DETAILED DESCRIPTION OF THE PREFERRED EMBODIMENTS

Figure 2:
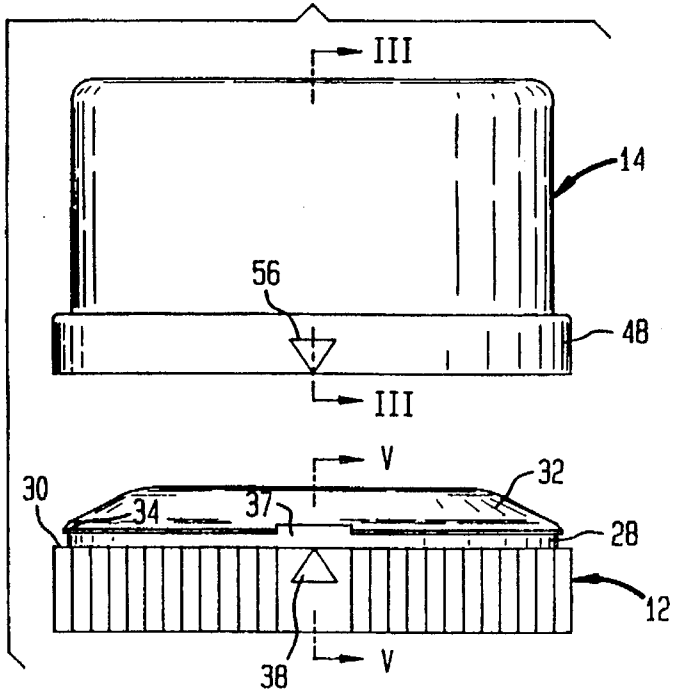
FIG. 2 is an exploded front view of the safety cap shown in FIG. 1.

One preferred embodiment of the present invention is shown in FIGS. 1–6. In this preferred embodiment, the safety cap of the present invention is generally designated by reference number 10. It includes a collar 12 and a cover 14 and may be mounted on a medium sized pressurized container 40.

As illustrated in FIGS. 1, 2, 5, and 6, the collar 12 includes a downwardly extending substantially vertical side wall 16 which has an external surface 18 and an internal surface 20. The internal surface 20 is clearly shown in FIG. 5 as including an undercut locking tab 22 which defines a relatively small inner diameter and a slightly enlarged internal surface 24 defining a slightly larger internal diameter. The purpose of the different size diameters of the undercut locking tab 22 and the internal surface 24 will be described further below with respect to mounting of the subject safety cap on an aerosol container such as container 40 shown in FIG. 1.

The internal surface 20 of the vertical side wall 16 also includes a seat 26 which is adapted to sit on a corresponding shoulder of an aerosol container as will also be described below. A groove 28 is clearly shown in FIGS. 1, 2, 5, and 6 on the external surface 18 of the substantially vertical side wall 16. A shoulder 30 is arranged just below the groove 28 on the opposite side of the seat 26. The groove 28 represents the top region of the substantially vertical side wall 16 of the collar 12 as shown in FIGS. 1, 2, 5, and 6.

Features of the cover 14 of the subject safety cap 10 are clearly shown in FIGS. 1–4. In particular, the cover 14 includes a relatively large diameter circumferential section 48 at the bottom thereof and a top section 58. As clearly shown in FIG. 4, the cover 14 includes a pair of ridges 50 and 52 which extend inwardly from the inner diameter of the relatively large circumferential section 48. In alternate embodiments, the number and placement of internal ridges, such as ridges 50 and 52, may vary. For example, the cover 14 may have only one ridge extending approximately one-third of the way around the inner circumference of the cover.

A projection 54 also extends inwardly from the inner diameter of the relatively large circumferential section 48. An alignment arrow 56 is placed on the external surface of the relatively large circumferential section 48 in a position opposing the projection 54. When the cover 14 and the collar 12 are placed in assembled position on a aerosol container, such as container 40, the cover 14 may be arranged in a removable position with respect to the collar 12, where alignment arrows 38 and 56 are aligned witch each other, or a locked position, where alignment arrows 38 and 56 are offset from each other.

Figure 1:
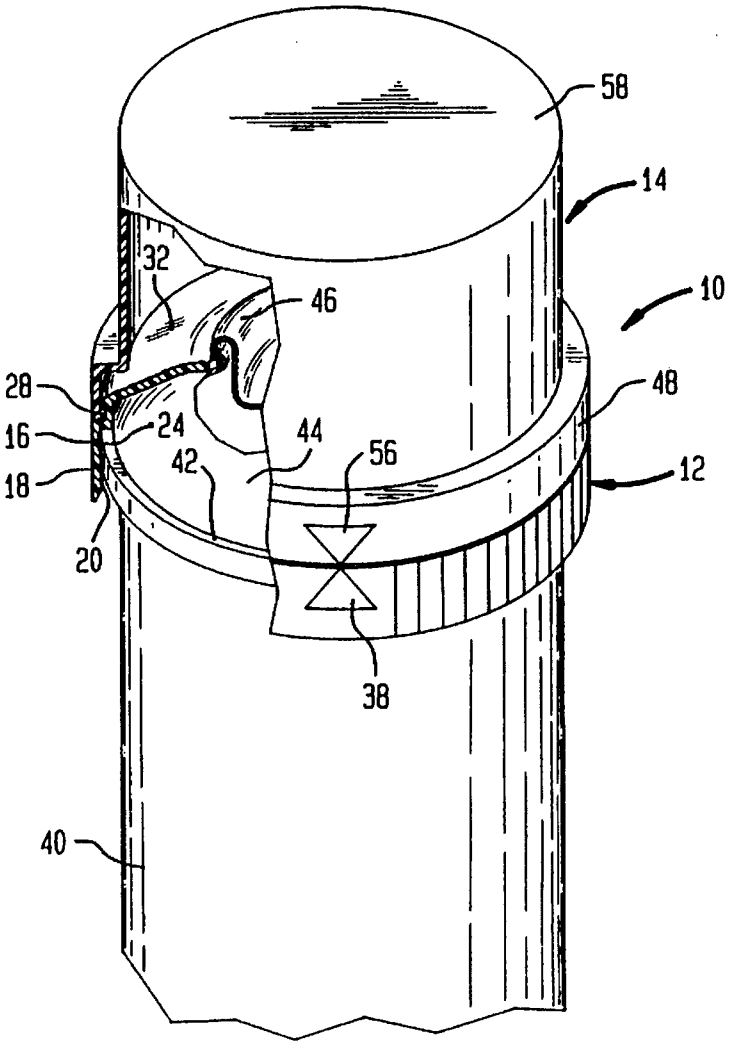
FIG. 1 is a perspective partial cross-sectional view of one embodiment of the safety cap of the present invention assembled on a relatively small sized aerosol container.
Figure 3:
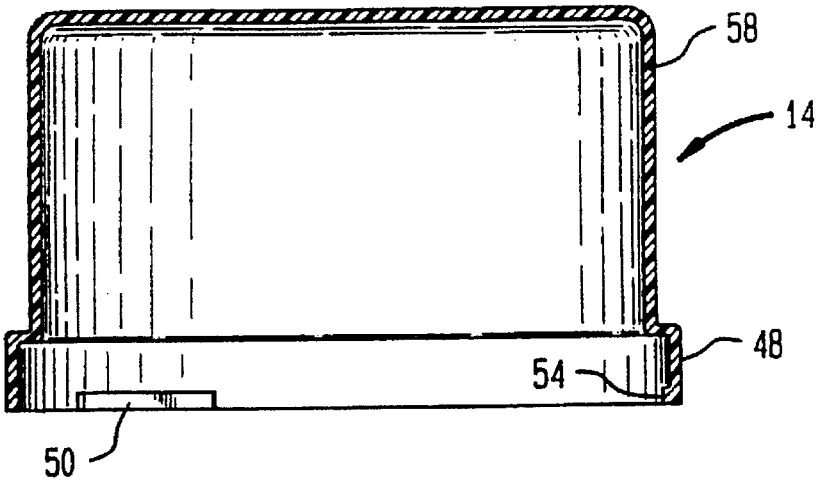
FIG. 3 is a cross-sectional view of the cover of the present safety cap taken along lines III—III shown in FIG. 2.
Figure 4:
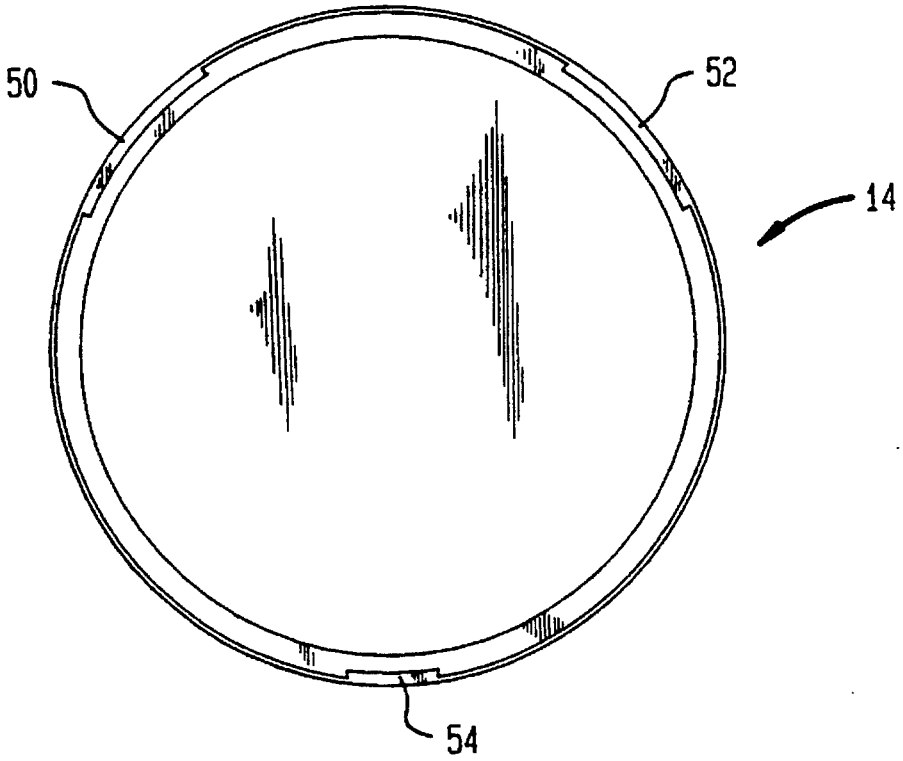
FIG. 4 is a bottom plan view of the cover of the safety cap shown in FIGS. 1–3.

As is clearly illustrated in FIG. 1, in assembled position, the collar 12 is placed on top of the aerosol container 40. More particularly, the seat 26 of the collar 12 is placed on top of the outer shoulder 42 of the container 40. The relatively large internal surface 24 is simultaneously arranged adjacent to the side wall the outer shoulder 42. At the same time, the undercut locking tab 22, which includes a diameter slightly smaller than the diameter of the internal surface 24, is forced beneath the lip of the outer shoulder 42. This cooperating structure is also shown in the partially cut away view of FIG. 1. As can be appreciated, the undercut locking tab 22 will facilitate locking of the collar 12 in an assembled position beneath the outer shoulder 42 of the container 40.

Figure 5:
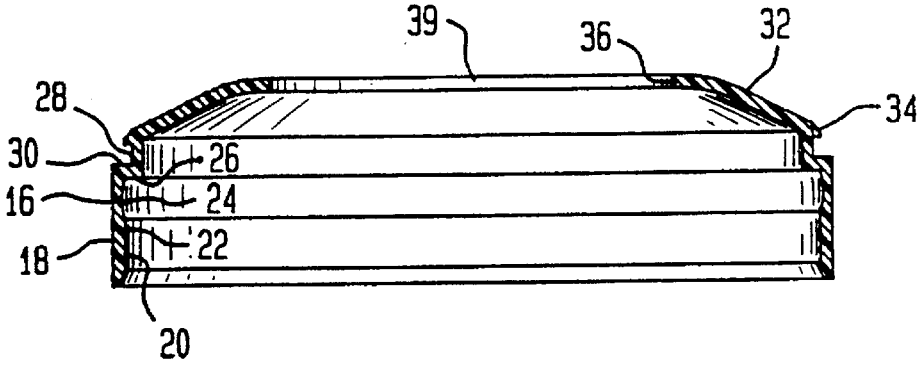
FIG. 5 is a cross-sectional view of the collar of the present safety cap taken along lines V—V shown in FIG. 2.
Figure 6:
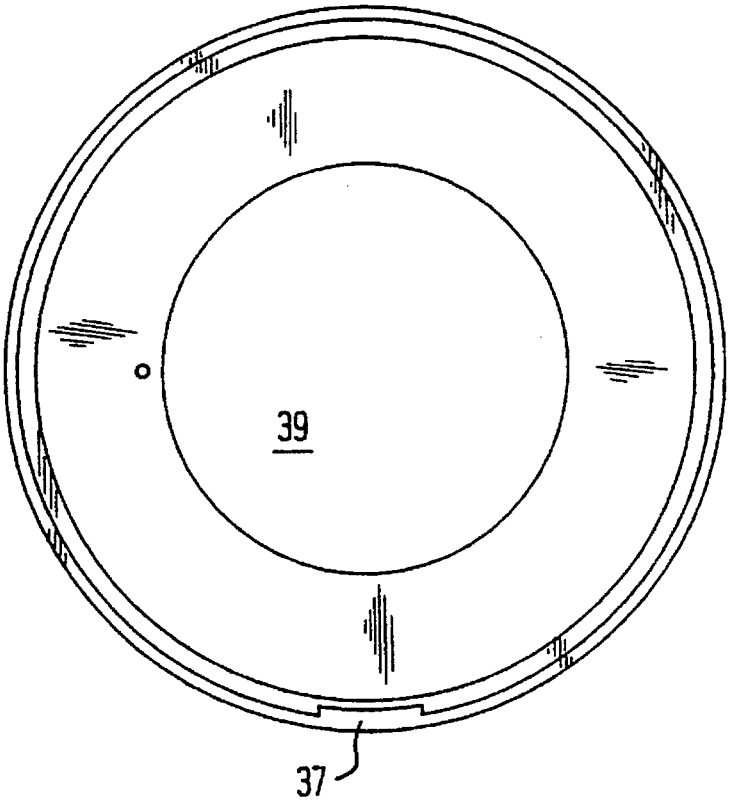
FIG. 6 is a top plan view of the collar of the safety cap shown in FIG. 5.

The top side 32 of the collar 12 is shown in FIGS. 5 and 6 as being a continuous disk-shaped ring. The top side 32 extends from a first side 34 adjacent to the grove 28 to an outermost end 36 which is arranged in assembled position beneath the valve rim 46 of the container 40 as illustrated in FIG. 1. The arrangement of the outermost end 36 of the top side 32 beneath a portion of the valve rim 46 acts in conjunction with the locking tab 22 to lock the collar 12 in assembled position on the aerosol container 40. A circular aperture 39 is arranged in the center of the top side 32. The diameter of the aperture 39 is defined by the outermost end 36. Although the aperture 39 is shown as including a circular shape in FIG. 6, this feature of the present invention may have various shapes and sizes in alternate embodiments. The significance of the aperture 39 is that it must be sufficiently large to allow a user of the associated container 40 to access a valve actuator, which will generally extend upwardly through the aperture 39.

In an alternate embodiment, the outermost end 36 will not extend all of the way to the valve rim 46. In this embodiment, the locking tab 22 arranged beneath the outer shoulder 42 will be the only mechanism for locking the collar 12 in assembled position on container 40. In another alternate embodiment, the substantially vertical side wall 16 may not include the undercut locking tab 22. In such an embodiment, it would be required for the outermost end 36 of the top side 32 to extend beneath the valve rim 46 to assure that the collar 12 is maintained in a locked position on top of the container 40.

The container 40 shown in FIG. 1 is a medium sized aerosol container. As such, the valve required to release the pressurized contents from the container 40 is relatively small. Thus, the valve 40 retains a low profile and does not extend a great distance above the outer shoulder 42. FIG. 1 illustrates a slightly bulbous top 44 on the container 40 which is indicative of the relatively small sized valve used in the aerosol container 40.

Figure 8:
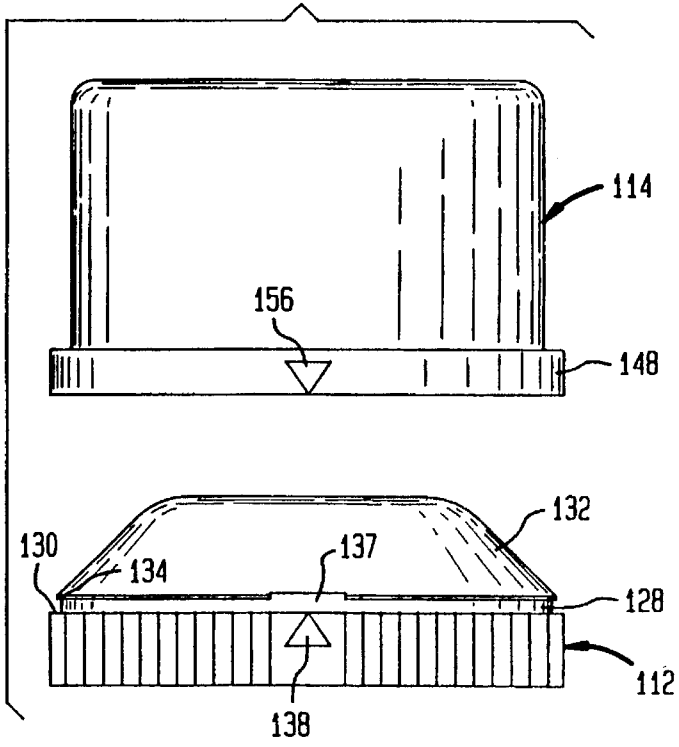
FIG. 8 is an exploded front view of the safety cap shown in FIG. 7.
Figure 7:
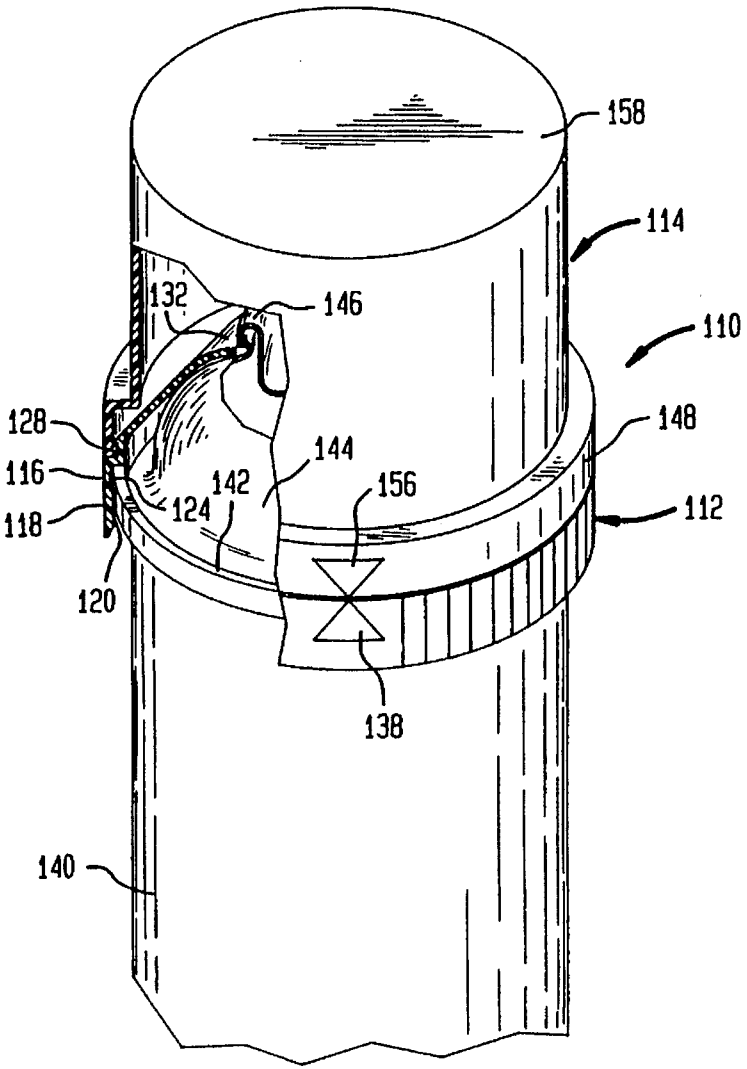
FIG. 7 is a perspective partial cross-sectional view of another embodiment of the safety cap of the present invention assembled on a relatively large sized aerosol container.

In order to accommodate the bulbous top 44, the top side 32 of the collar 12 extends upwardly at a relatively slight angle from a horizontal plane which extends through the annular groove 28. As will be appreciated with reference to an alternate embodiment of the present invention discussed below, the top side 32 may extend upwardly away from the horizontal plane at a greater angle when the bulbous top portion of the container is larger than the bulbous top 44 of the container 40. Such an embodiment is shown in FIGS. 7 and 8 wherein the bulbous top portion 144 of the associated aerosol container 140 is relatively large.

When the cover 14 is in assembled position on the collar 12, the ridges 50 and 52 are placed within the groove 28. In order to easily place the cover 14 on the collar 12, or to remove the cover 14 therefrom, the alignment arrow 56 must be aligned with alignment arrow 38. When this arrangement is obtained, the projection 54 will be aligned with the recess 37 so that the projection 54 can be placed along with the ridges 50 and 52 within the groove 28 of the collar 12. It should be appreciated that the cover 14 can be placed on the collar 12 by applying a sufficient amount of pressure so that the ridges 50 and 52 and the projection 54 will be forced over the first side 34 of the collar 12 and into the annular groove 28. However, this is not the preferred method of mounting the cover 14 on the collar 12 as it requires much more effort than simply aligning the arrows 38 and 56, and thereafter placing the cover 14 on the collar 12.

If the alignment arrows 38 and 56 are not placed in correspondence with each other, the cover 14 will be in a locked position with respect to the collar 12. However, when the alignment arrows 38 and 56 are aligned with each other, the cover 14 can be simply pulled off of its assembled position on the collar 12.

The present invention has been designed to include an added element of safety over prior art devices. This is obtained by the cooperating structural dimensions of the collar 12 and the cover 14 which are such that the collar 12 can be freely rotated, when it is arranged in assembled position, on the outer shoulder 42 of the container 40. This rotation can be accomplished because the diameter of the portion of the internal surface 24 that is arranged adjacent to the side of the outer shoulder 42 is slightly greater than the external diameter defined by the outer shoulder 42. Additionally, the distance between the undercut locking tab 22 and the seat 26 is such that it is slightly larger than the corresponding size of the outer shoulder 42.

The additional safety element that has been designed into the present invention is that the top cover 14 and the collar 12 are sized so that they are normally in frictional engagement with each other when placed in assembled position. Thus, if the cover 14 is in a locked position on the collar 12, the cover 14 will rotate along with the collar 12 if a user attempts to rotate either of the components when mounted on container 40. Accordingly, once the cover 14 is placed in a locked position with respect to the collar 12, it cannot be removed simply by rotating one of the two components of the safety cap 10. The only way in which it can be removed is if a user rotates one of the components (i.e., the collar 12 or the cover 14) while restraining movement of the other component. This will permit the user to overcome the normal frictional engagement between the two components so that the alignment arrows 38 and 56 can be placed in and out of alignment with each other as desired.

The dimensions of the cooperating adjacent components of the top cover 14 and the collar 12 must be selected so that they are small enough to retain the component in normal frictional engagement with each other, but must be large enough to permit the frictional engagement to be easily overcome when one of the two components is held while the other one is rotated. Additionally, the material selected for manufacture of the safety cap 10 should be selected so as to permit the frictional engagement to be easily overcome when one of the two components is restrained while the other one is rotated. As may be appreciated, the collar 12 and the cover 14 are preferably made of a polymer or plastic material such as polypropylene. However, many substitute materials can be used to manufacture these components.

Although the size of the components of the collar 12 and the cover 14 may vary depending upon the particular sized container on which they are to placed, examples will now be given of sizes of a preferred embodiment of the present invention which may be used as a safety cap on a medium sized aerosol container, such as container 40. Such a container may be an eight ounce container of oven cleaner or the like.

In the preferred embodiment shown in FIGS. 1–6, the diameter of the relatively large internal surface 24 of the vertical side wall 16 may be about 2,183 inches. This diameter is slightly larger than the diameter defined by the undercut locking tab 22 which may be about 2,157 inches. The distance between the seat 26 and the raised portion of the undercut locking tab 22 may be approximately 0.124 inch. The aforementioned dimensions should be sufficient to lock the collar 12 on the outer shoulder 42 of a medium sized container 40, while still permitting free rotation the collar 12 thereon.

The diameter defined by the groove 28 may be about 2.114 inches. The diameter between the ridges 50 and 52 and the projection 54 is selected to correspond with the diameter of the groove. The largest internal diameter of the bottom section 48 of the cover 14 would be about 2.157 inches. The height or length of the groove between the shoulder 30 and the top portion of the groove just beneath the first end 34 of the top side 32 may be about 0.063 inches. This dimension is compatible with the thickness or height of the ridges 50 and 52 which may be about 0.058 inch. The ridges and the projection may be tapered at an angle of about 13° extending from the outer most portion thereof toward the larger diameter section of the cover.

The structure of the present safety cap 10 is particularly desirable since it permits the collar 12 to be securely and substantially permanently mounted on the top of an aerosol can, while at the same time permitting free rotation of the collar. The aforementioned normal frictional engagement between the collar 12 and the cover 14 is advantageous as it provides an added safety feature that may prevent a young child from aligning the arrows 38 and 56 while an adult can easily understand that one of the components must be restrained while the other one is rotated in order to align the arrows 38 and 56 with each other so that the cover 14 can be removed from the collar 12. While this concept is quite simple to a knowledgeable adult, it will not be readily apparent to a young child unless that child is specifically taught how to remove the cover 14 from the collar 12 by a knowing adult. Thus, this feature of the present invention provides an additional safety characteristic which minimizes the chances of the cover 14 being accidentally removed by a child.

FIGS. 7 and 8 show an additional embodiment of the present invention wherein the structure and operation of the safety cap 110 is substantially identical to the structure and operation of the safety cap 10. The only difference is that the safety cap 110 is larger and it is shown mounted on relatively large sized aerosol container 140. Since all of the components are substantially identical, they have been designated in FIGS. 7 and 8 by like reference numerals preceded by a 1. Besides the large dimensions of the corresponding collar 112 and cover 114, the only appreciable difference of those components from the collar 12 and the cover 14 of the earlier described embodiment is that the top side 132 extends upwardly from a horizontal plane at a greater angle than the top side 32. This structure is necessary to permit the top side 132 to fit over a relatively large bulbous top 144 in which a relatively large valve is arranged. All other structural and operational features of the large sized safety cap 110 are identical to the structural and operational features of the smaller sized safety cap 10. Thus, a discussion of these features will not be repeated herein.

The foregoing description and figures are directed toward preferred embodiments of the present invention. It should be appreciated, that numerous modifications can be made to each of the components of the subject safety cap. In fact, such modifications are encouraged to be made to the materials and structure of the disclosed embodiments of the present invention without departing from the spirit and scope thereof. Thus, the foregoing description of the preferred embodiment should be taken in way of illustration rather than by way of limitation as the present invention is defined by the claims set forth below.

I claim:

1. A safety cap in combination with a container having an outer annular shoulder and an annular valve rim located radially inwardly and axially above said shoulder, said safety cap comprising:

a collar having a substantially vertical side wall including an inner surface and an outer surface, said collar being seated on the outer shoulder of the container when in assembled position with said inner surface adjacent said outer shoulder, said collar including a groove extending circumferentially adjacent said outer surface of said vertical side wall, said-collar further including a top side extending away from said substantially vertically side wall at an angle toward the valve rim of said container, said top side having a first end and a second end, whereby said second end of said top side terminates beneath at least a portion of the valve rim to lock said collar in place on said container; and a cover mountable on said collar for selective movement between a locked position at which said cover is locked on said collar and a removable position at which said cover can be easily removed from its mounted arrangement on said collar, said cover having an inner surface and an outer surface, said cover including at least one ridge and a projection attached to said inner surface and extending inwardly therefrom, said collar including a recess arranged adjacent to said groove for permitting said cover to be mounted on said collar and removed therefrom, said ridge being mountable within said groove of said collar and said projection being sized and shaped to fit within said recess and said groove so that said cover can be selectively rotated on said collar between the locked and the removable positions.

2. The safety cap and container combination of claim 1 wherein said first end of said top side of said collar is connected to said substantially vertical side wall at a location adjacent said groove.

3. The safety cap and container combination of claim 1 wherein said top side of said collar is a continuous circumferential ring between said first end arranged adjacent to substantially vertical side wall and said second end extending to a location beneath the valve rim of the associated container.

4. The safety cap and container combination of claim 1 wherein said substantially vertical side wall of said collar defines a shoulder arranged adjacent to and beneath said groove so that said groove is disposed between said shoulder and said top side of said collar, said cover having a bottom lip seatable on said shoulder of said collar when said at least one ridge and said projection of said cover are arranged within said groove.

5. The safety cap and container combination of claim 1 further comprising alignment means for providing an indication when said cover is arranged in said locked or removable position with respect to said collar.

6. The safety cap and container combination of claim 5 wherein said alignment means comprises a plurality of distinguishing marks arranged on said outer surfaces of said collar and said cover to indicate when said projection of said cover is aligned with said recess of said collar thereby indicating that said cover is arranged in said removable or locked position.

7. The safety cap and container combination of claim 1 wherein said outer shoulder of the container of a top surface arranged in a horizontal plane which is located below the valve rim of the container, said top side extending upwardly between the outer shoulder and the valve rim at a positive angle with respect to the horizontal plane of the outer shoulder.

8. The safety cap and container combination of claim 1 wherein said inner surface of said collar includes a locking tab defining a second inner diameter which is slightly smaller than said first inner diameter and the diameter defined by the outer shoulder of said container, said locking tab being arranged at a location on the inner surface of said substantially vertical side wall below the location defined by said first inner diameter so that said locking tab is forced below the outer shoulder of said container to act in conjunction with said top side of said container to facilitate locking of said collar on said container.

9. The safety cap and container combination of claim 1 wherein said inner surface of said collar defines an inner diameter sized slightly greater than the diameter defined by the outer shoulder of said container so that said collar is freely rotatable on the container while being permanently mounted thereon.

10. The safety cap and container combination of claim 9 wherein said cover and said collar further comprise friction engagement means for providing an initial frictional engagement between said collar and said cover when arranged in assembled position whereby rotation of said collar on said container will cause corresponding rotation of said cover and vice versa so that said cover cannot be removed from the locked position on said collar unless a person simultaneously holds both said cover and said collar and rotates one of said cover and said collar while restraining movement of the other component thus overcoming said initial frictional engagement until said cover is arranged in said removable position.

11. The safety cap and container combination of claim 10 wherein said first end of said top side of said collar is connected to said substantially vertical side wall at a location adjacent said groove.

12. The safety cap and container combination of claim 11 wherein said top side of said collar is a continuous circumferential ring between said first end arranged adjacent to substantially vertical side wall and said second end extending to a location beneath the valve rim of said container.

13. The safety cap and container combination of claim 12 wherein said substantially vertical side wall of said collar defines a shoulder arranged adjacent to and beneath said groove so that said groove is disposed between said shoulder and said top side of said collar, said cover having a bottom lip for seating on said shoulder of said collar when said at least one ridge and said projection of said cover are arranged within said groove.

14. The safety cap and container combination of claim 13 further comprising alignment means for providing an indication when said cover is arranged in said locked or removable position with respect to collar.

15. The safety cap and container combination of 14 wherein said alignment means comprises a plurality of distinguishing marks arranged on said outer surfaces of said collar and said cover to indicate when said projection of said cover is aligned with said recess of said collar thereby indicating that said cover is arranged in said removable or locked position.

16. The safety cap and container combination of 15 wherein said outer shoulder of the container of a top surface arranged in a horizontal plane which is located below the valve rim of the container, said top side extending upwardly between the outer shoulder and the valve rim at a positive angle with respect to the horizontal plane of the outer shoulder.

17. The safety cap and container combination of 16 wherein said inner surface of said collar includes a locking tab defining a second inner diameter which is slightly smaller than said first inner diameter and the diameter defined by the outer shoulder of said container, said locking tab being arranged at a location on the inner surface of said substantially vertical side wall below the location defined by said first inner diameter so that said locking tab is forced below the outer shoulder of said container to act in conjunction with said top side of said container to facilitate locking of said collar on said container.

* * * * *

UNITED STATES PATENT AND TRADEMARK OFFICE

CERTIFICATE OF CORRECTION

PATENT NO. : 5,520,305

DATED : May 28, 1996

INVENTOR(S) : Pierson

It is certified that error appears in the above-indentified patent and that said Letters Patent is hereby corrected as shown below:

Column 5, line 2, delete "witch" and insert --with-- therefore.
Column 7, line 9, delete "2,183" and insert --2.183-- therefore.
Column 7, line 11, delete "2,157" and insert --2.157-- therefore.
Column 8, line 54, delete "the associated" and insert --said-- therefore.
Column 10, line 20, delete "combination of 14" and insert --combination of claim 14-- therefore.
Column 10, line 27, delete "combination of 15" and insert --combination of claim 15-- therefore.
Column 10, line 35, delete "combination of 16" and insert --combination of claim 16-- therefore.

Signed and Sealed this

Twenty-seventh Day of August, 1996

Bruce Lehman

*Attest:*

BRUCE LEHMAN

*Attesting Officer*

*Commissioner of Patents and Trademarks*